US007588156B2

(12) United States Patent
Lorenz et al.

(10) Patent No.: US 7,588,156 B2
(45) **Date of Patent: *Sep. 15, 2009**

(54) COLLAPSIBLE CONTAINER FOR TRANSPORT AND STORAGE OF GOODS

(75) Inventors: Reinhard Lorenz, Uelsen (DE); Axel Sommer, Tacoma, WA (US)

(73) Assignee: Schoeller Arca Systems AB, Perstorp (SE)

( * ) Notice: Subject to any disclaimer, the term of this patent is extended or adjusted under 35 U.S.C. 154(b) by 526 days.

This patent is subject to a terminal disclaimer.

(21) Appl. No.: 11/268,966

(22) Filed: Nov. 8, 2005

(65) Prior Publication Data

US 2006/0060580 A1 Mar. 23, 2006

Related U.S. Application Data

(63) Continuation-in-part of application No. 10/446,969, filed on May 28, 2003, now Pat. No. 7,175,040.

(30) Foreign Application Priority Data

Dec. 3, 2002 (SE) ..... 0203613

(51) Int. Cl.
*B65D 6/00* (2006.01)
*B65D 8/14* (2006.01)

(52) U.S. Cl. ..... 220/6

(58) Field of Classification Search ..... 220/6, 220/7; 206/807

See application file for complete search history.

(56) References Cited

U.S. PATENT DOCUMENTS 3,796,342 A 3/1974 Sanders et al.
3,870,185 A 3/1975 Sanders et al.
4,523,692 A 6/1985 Lemkin
4,658,980 A 4/1987 Lindstrom
4,798,304 A 1/1989 Rader
4,863,056 A 9/1989 Inayama
4,913,302 A 4/1990 Stonier
5,038,953 A 8/1991 Radar (Continued)

FOREIGN PATENT DOCUMENTS

JP 06024440 A 2/1994

(Continued)

*Primary Examiner*—Harry A Grosso
(74) *Attorney, Agent, or Firm*—Scully, Scott, Murphy & Presser, P.C.

(57) ABSTRACT

Collapsible container (1), which includes a carrying base part (20), collapsible side walls (30) and a lid (40). The side walls (30) are movably attached to said base part (20) by lower hinge members (31). The first and second side walls are moveably attached to an upper frame member (50) via upper hinge members (35). An upper edge of third and fourth side walls (33 and 34 respectively) are each provided with at least one locking lip (37), limiting the outwards movement by interacting with an inner edge (51) of upper frame member (50). The lid (40) is provided with an inner rim (41) which is interacting with inner edge (51) of upper frame member (50). The inner rim (41) is furthermore interacting with locking lips (37) thereby limiting inwards movement of third and fourth side walls (33 and 34 respectively) while lid (40) is arranged on collapsible container (1) whereby undesired collapsing of said collapsible container (1) is prevented when lid (40) is arranged on container (1).

14 Claims, 5 Drawing Sheets

U.S. PATENT DOCUMENTS

| | | | | |
|---|---|---|---|---|
| 5,064,068 | A | 11/1991 | Sheng | |
| 5,429,261 | A | 7/1995 | Machino | |
| 5,651,652 | A | 7/1997 | Williams et al. | |
| 6,230,916 | B1 | 5/2001 | Bradford et al. | |
| 6,364,096 | B1 | 4/2002 | De Baets et al. | |
| 6,616,003 | B1 | 9/2003 | Polenta | |
| 6,868,979 | B2 * | 3/2005 | Rader | 220/7 |
| 7,175,040 | B2 * | 2/2007 | Lorenz et al. | 220/6 |
| 2004/0222221 | A1 | 11/2004 | Rader | |

FOREIGN PATENT DOCUMENTS

| | | | |
|---|---|---|---|
| JP | 06247445 | A | 9/1994 |

* cited by examiner

COLLAPSIBLE CONTAINER FOR TRANSPORT AND STORAGE OF GOODS

CROSS REFERENCE TO RELATED APPLICATION

This application is a continuation-in-part application of U.S. patent application Ser. No. 10/446,969, filed May 28, 2003, now U.S. Pat. No. 7,175,040, issued on Feb. 13, 2007.

BACKGROUND OF THE INVENTION

1. Field of the Invention

The present invention relates to collapsible container for transport and storage of goods.

2. Description of Related Prior Art

Collapsible containers are rather popular since they will make a radical saving of the empty return transport volume possible. Foldable containers are advantageously made of thermoplastic materials which will give light and still sturdy containers which are easy to keep clean. Another advantage is that the tare-weight of such containers is very stable which is not the case with, for example, wood containers where the tare-weight can double when the wood becomes wet. Yet another advantage is that thermoplastic materials do not corrode, which is the case with containers made from metal such as steel and aluminum. Most thermoplastic materials furthermore have a good resistance to chemical substances such as acids and bases, which is not the case with most metals.

A container will have to cope with a vast number of different mechanical strains during its life cycle, and there are some cases where foldable containers of thermoplastic material have not been possible to use due to unfavourable cases of load. It is also desired to have packaging which is difficult to tamper with without leaving clearly visible traces.

SUMMARY OF THE INVENTION

It has, through the present invention, been made possible to solve the above-mentioned problem so that a collapsible container can be used for the handling of goods. The invention relates to a collapsible container for transport and storage of goods, which container includes a carrying base part, a plurality of collapsible side walls and a lid. The side walls are movably attached to said base part by means of lower hinge members. The side walls are arranged as a first and a second side wall being arranged parallel to each other. There is further a third and a fourth side wall being arranged parallel to each other and adjacent to the first and the second side walls. The first and second side walls are moveably attached to an upper frame member via upper hinge members. The first and second side wall are further parted into each an upper and a lower section via a vertical folding line. An upper edge of said third and fourth side walls are each provided with at least one locking lip. These locking lips limits the outwards movement of said third and fourth side walls by interacting with an inner edge of said upper frame member. The lid is provided with an inner rim which interacts with the inner edge of the upper frame member. This inner rim furthermore interacts with the locking lips thereby limiting inwards movement of the third and fourth side walls while the lid is arranged on the collapsible container. Undesired collapsing of the collapsible container is hereby prevented while the lid is properly arranged on the container.

A container according to the present invention is preferably manufactured through means of a manufacturing method selected from the group consisting of; injection moulding, vacuum moulding, blow moulding and press moulding. The container is suitably manufactured of a polymeric material selected from the group consisting of; polyethylene, polypropylene, polybutene, polyvinylchloride, polyalkylene-therephtalate, acrylonitrile-butadiene-styrene-copolymer, polyamide, polycarbonate and a combination thereof.

The lid may according to one embodiment of the invention be provided with gripping lid coupling members in at least two opposite edges. These coupling members are intended to interact with corresponding rim coupling members at the upper edge of the upper frame member.

According to a preferred embodiment of the invention the lid is provided with coupling hole members in at least two opposite edges. These coupling hole members are intended to interact with corresponding rim coupling hole members at the upper edge of the upper frame member. The coupling hole members and rim coupling hole members are arranged so as to allowing a sealing pin to be inserted through said coupling hole members and rim coupling hole members.

The sealing pin is preferably provided with snapping wedges and a manoeuvring section. The locking pin is further dimensioned to break at removal whereby unauthorised tampering with said collapsible container is made detectable.

The lid is further suitably provided with an upper rim. This upper rim is dimensioned to receive a footprint of said base part thereby securing vertical alignment of stacked collapsible containers with lids arranged thereon.

The upper frame member preferably allows the lid to be arranged thereon when the collapsible container is in both erected and collapsed state.

DETAILED DESCRIPTION OF EMBODIMENT EXAMPLES

The invention is described in more detail together with enclosed illustrations showing different embodiment of the invention whereby, FIG. 1 shows in perspective view a collapsible container 1 with a lid 40.

Figure 5A:
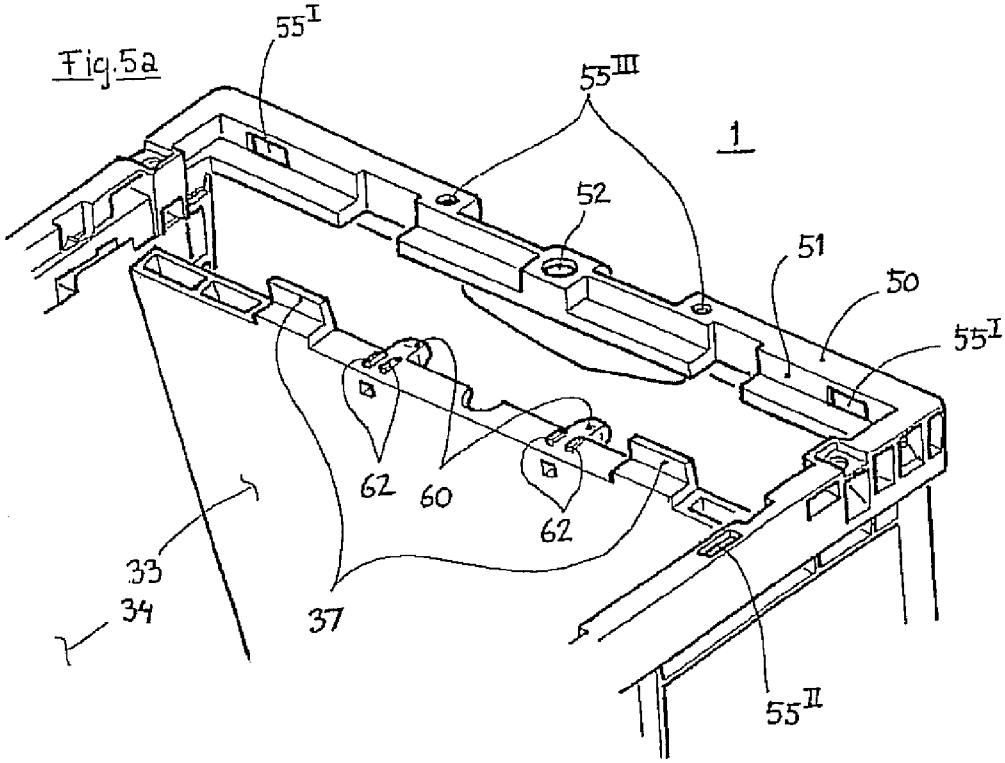
Figure 5B:
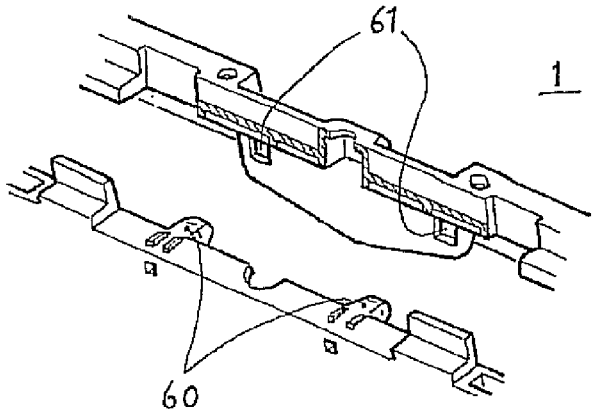

FIGS. 5*a*-5*b* shows in perspective view upper inside parts of a collapsible container 1 according to a preferred embodiment of the invention.

Figure 6:
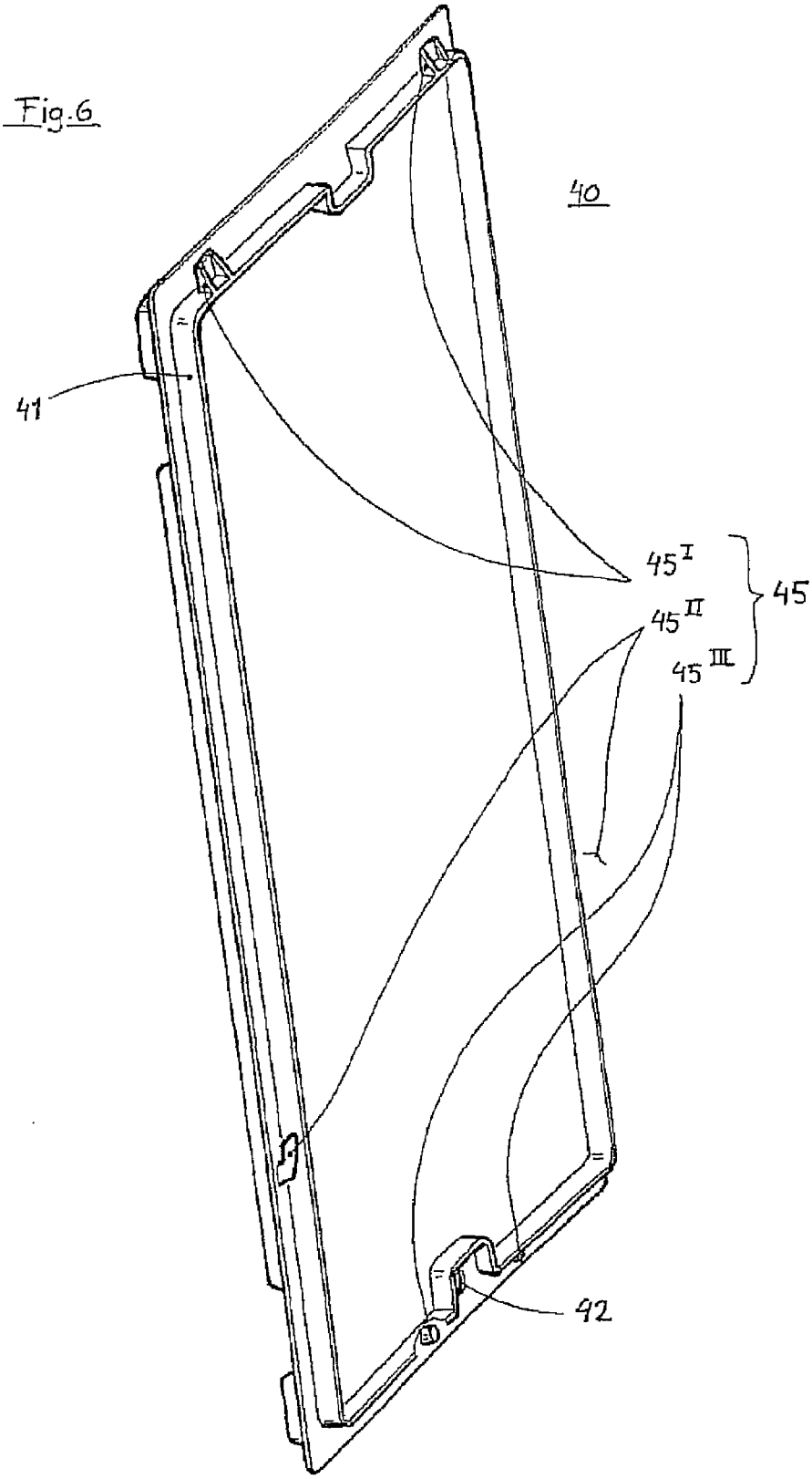

FIG. 6 shows in perspective view a lower side of a lid 40 according to a preferred embodiment of the invention.

Figure 7:
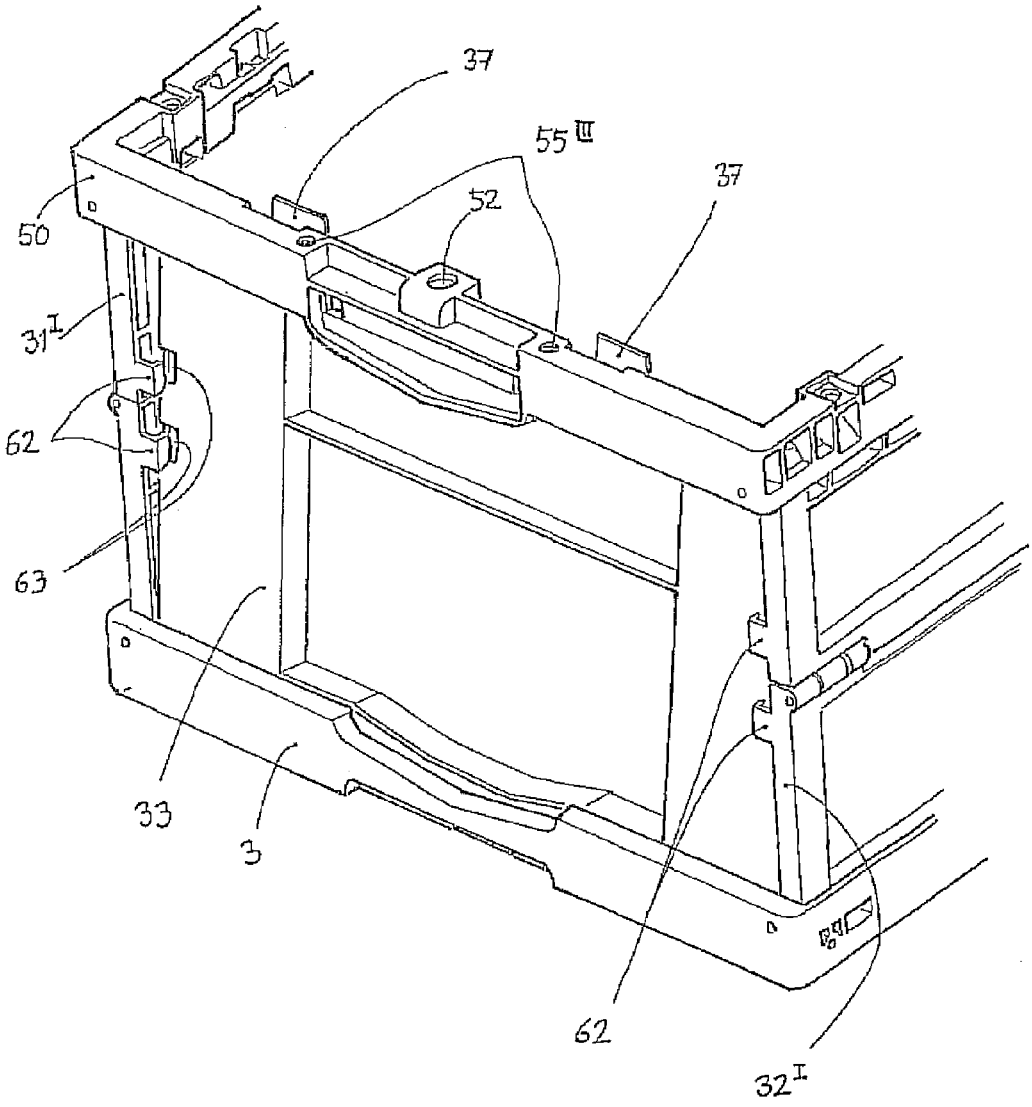

FIG. 7 shows in perspective view outside parts of a collapsible container 1 according to a preferred embodiment of the invention.

DETAILED DESCRIPTION OF THE INVENTION

Figure 1:
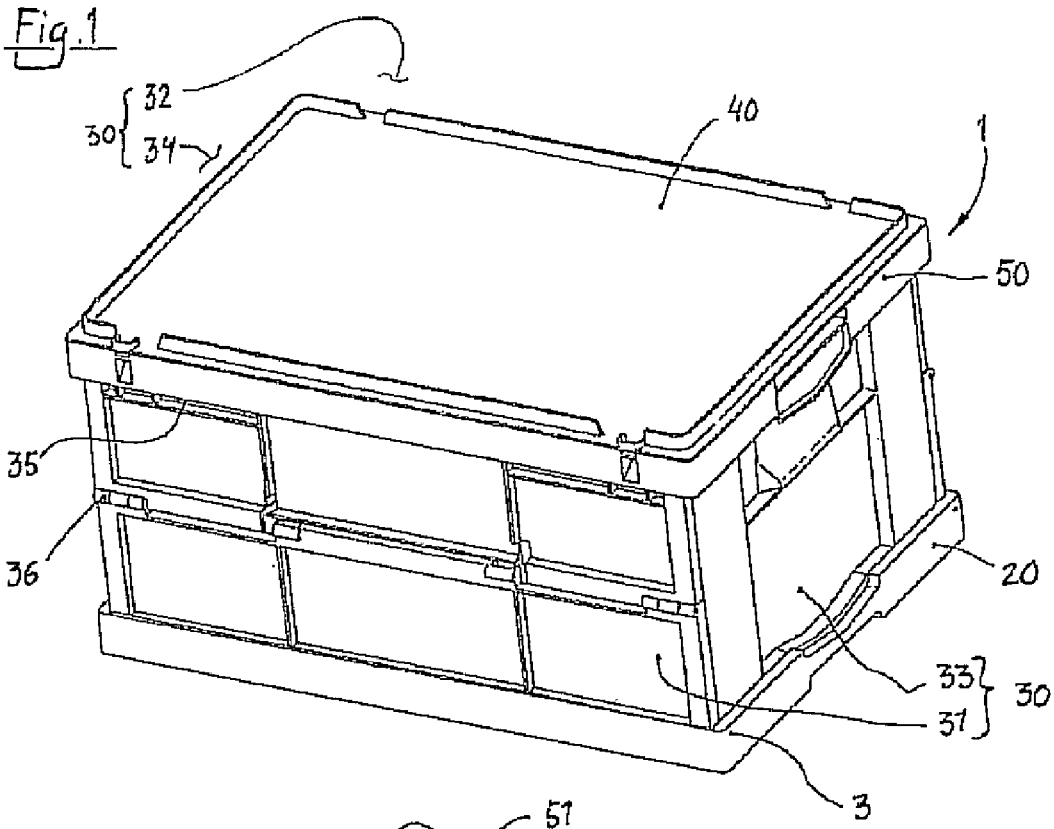

Referring now to FIG. 1 showing a collapsible container 1 for transport and storage of goods. The container includes a carrying base part 20, and four collapsible side walls 30. The side walls are arranged as a first and a second side wall 31 and 32 respectively, being arranged parallel to each other and a third and a fourth side wall 33 and 34 respectively, being arranged parallel to each other and adjacent to the first and the second side walls 31 and 32 respectively. The second and fourth side walls 32 and 34 respectively, are arranged on sides not visible in the FIG. 1. The container is further provided with a lid 40. Said side walls 30 are movably attached to said base part 20 by means of lower hinge members 3. Said first and second side walls 31 and 32 respectively are moveably attached to an upper frame member 50 via upper hinge members 35. The first and second side wall 31 and 32 respectively, are further being parted into each an upper and a lower section via a vertical folding line 36.

Figure 2:
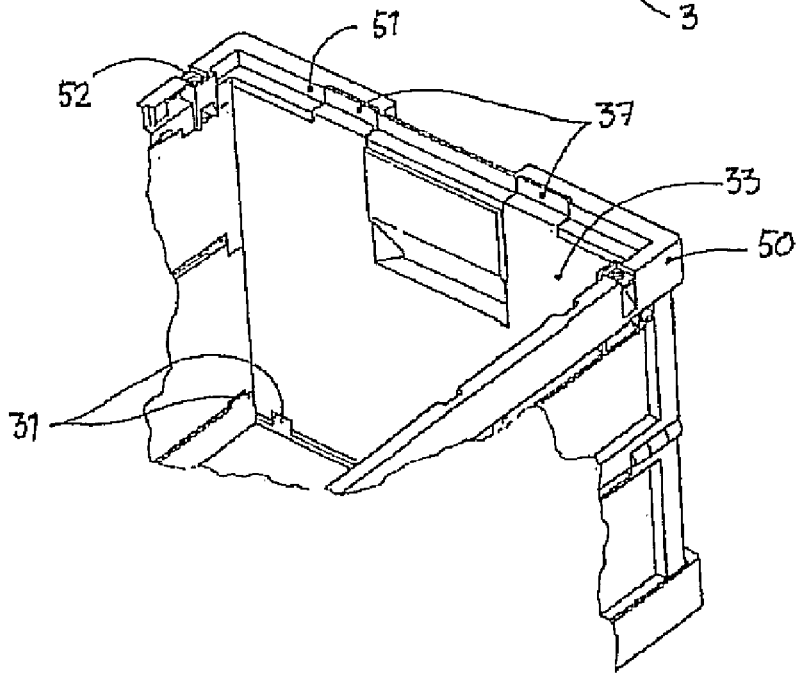
FIG. 2 shows in perspective view upper inside parts of a collapsible container 1.

Referring now to FIG. 2 showing an upper edge of the third side wall 33. Said third and fourth side walls 33 and 34 respectively, are each provided with two locking lips 37. The locking lips 37 limits the outwards movement of said third and fourth side walls 33 and 34 respectively, by interacting with an inner edge 51 of said upper frame member 50.

Figure 3:
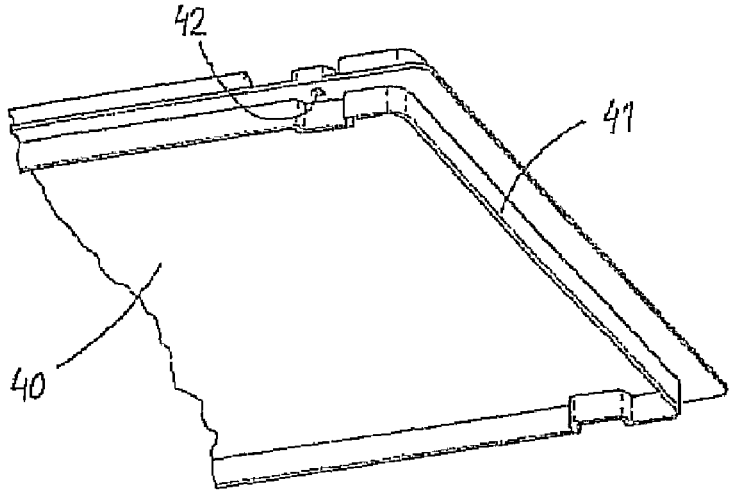
FIG. 3 shows in perspective view a lower side of a lid 40.

Referring now to FIG. 3 showing a lower side of a lid 40. Said lid 40 is provided with an inner rim 41. This inner rim 41 interacts with said inner edge 51 (see FIG. 2) of said upper frame member 50. The inner rim 41 furthermore interacts with the locking lips 37 (see FIG. 2) thereby limiting inwards movement of said third and fourth side walls 33 and 34 respectively (see FIG. 2), while the lid 40 is arranged on the collapsible container 1. Undesired collapsing of said collapsible container 1 is thereby prevented while said lid 40 is properly arranged on said collapsible container 1.

Figure 4:
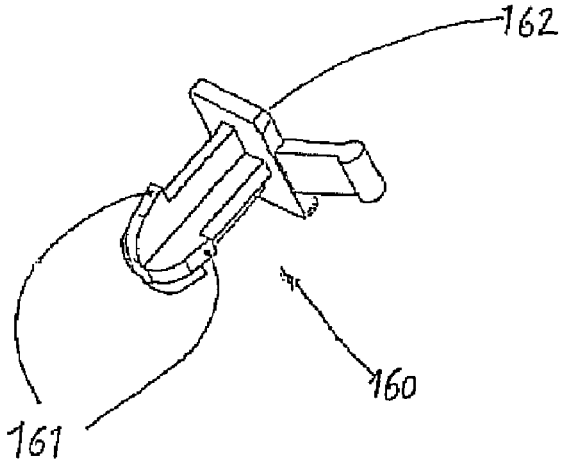
FIG. 4 shows in perspective view an accessory in the form of a sealing pin 60.

The lid 40 is provided with coupling hole members 42 (see FIG. 1) in at least two opposite edges which coupling hole members 42 interacts with corresponding rim coupling hole members 52 (see FIG. 2) at the upper edge of the upper frame member 50. The coupling hole members 42 and rim coupling hole members 52 are arranged so as to allowing a sealing pin 160 (see FIG. 4) to be inserted through said coupling hole members 42 and rim coupling hole members 52. The sealing pin 160 is provided with snapping wedges 161 and a manoeuvring section 162. According to a special embodiment of the invention the locking pin 160 is dimensioned to break at removal whereby unauthorised tampering with said collapsible container 1 is made detectable. The lid 40, as best seen in FIG. 1, is provided with an upper rim 43. The upper rim 43 is dimensioned to receive a footprint of said base part 20, thereby securing vertical alignment of stacked collapsible containers 1 with lids 40 arranged thereon.

The upper frame member 50 allows the lid 40 to be arranged thereon when the collapsible container 1 is in both erected and collapsed state.

A collapsible container, as herein disclosed, is suitably manufactured through means of injection moulding of polyethylene or polypropylene.

It is furthermore advantageous to provide the third and fourth side walls 33 and 34 respectively with a locking pin which inserted into a hole on the inside of the upper rim 51. This hole and locking pin is preferably arranged so that one such locking pin and matching hole is located on either side of the handle area. The third and fourth side walls 33 and 34 respectively will hereby take up loads when the container 1 is carried in the handles. Without this solution the upper rim 50 will bend upwards on the short sides when the container 1 is carried in the handles 53 especially when the container 1 contains heavy goods.

Referring now to FIGS. 5*a*-5*b* and 6 showing portions of a collapsible container 1 for transport and storage of goods and a lid according to a preferred embodiment of the invention. The container 1 corresponds in the main with the container shown in FIG. 1. An upper edge of said third and fourth side walls 33 and 34 respectively are each provided with at least one locking lip 37. The locking lips 37 limits the outwards movement of said third and fourth side walls 33 and 34 respectively by interacting with an inner edge 51 of said upper frame member 50. A lid 40 (see FIG. 6) is provided with an inner rim 41, said inner rim 41 interacting with the inner edge 51 of the upper frame member 50. The inner rim 41 furthermore interacts with the locking lips 37 thereby limiting inwards movement of the third and fourth side walls 33 and 34 respectively while the lid 40 is arranged on said collapsible container 1. Undesired collapsing of the collapsible container 1 is hereby prevented while said lid 40 is properly arranged on said container 1. The third and fourth side walls 33 and 34 respectively are further provided with each two locking pins 60 which each are inserted into one matching hole 61 (see FIG. 5*b*, where portions are cut away to facilitate understanding) arranged on the inside of the upper rim 51. The hole 61 and locking pin 61 is arranged so that the locking pin 60 and its matching hole 61 will transfer loads exerted on the upper frame 50. The third and fourth side walls 33 and 34, respectively, may also be provided with snapping elements (not shown), each of which snaps into engagement with portions of the upper frame 50.

The lid 40 is provided with gripping lid coupling members 45 (see FIG. 6) in the form of edge gripping lid coupling members $\mathbf{45}^{I}$ (see FIG. 6) arranged at a short side edge. The edge gripping lid coupling members $\mathbf{45}^{I}$ are intended to interact with edge hole rim coupling members $\mathbf{55}^{I}$ (see FIGS. 5*a*-5*b*) arranged on the inside of the upper frame member 50. The edge gripping lid coupling members $\mathbf{45}^{I}$ and the edge hole rim coupling members $\mathbf{55}^{I}$ are intended to engage one another by horizontal sliding of the lid 40.

The lid 40 is further provided with gripping lid coupling members 45 in the form of top edge gripping lid coupling members $\mathbf{45}^{II}$ (see FIG. 6) arranged on the two long side edges. The top edge gripping lid coupling members $\mathbf{45}^{II}$ are intended to interact with top edge slot rim coupling member $\mathbf{55}^{II}$ (see FIGS. 5*a*-5*b*) arranged on the top side of the upper frame member 50. The top edge gripping lid coupling members $\mathbf{45}^{II}$ and the top edge slot rim coupling members $\mathbf{55}^{II}$ are intended to engage one another by downwards movement followed by horizontal sliding of the lid 40.

The lid 40 is also provided with gripping lid coupling members 45 in the form of lid knob coupling members $\mathbf{45}^{III}$ (see FIG. 6) arranged at a short side edge. The lid knob coupling members $\mathbf{45}^{III}$ are intended to interact with knob hole rim coupling members $\mathbf{55}^{III}$ (see FIGS. 5*a*-5*b*) arranged on the inside of the upper frame member 50. The lid knob coupling members $\mathbf{45}^{III}$ and the knob hole rim coupling members $\mathbf{55}^{III}$ are intended to engage one another by downwards movement of the lid 40.

The lid knob coupling members $\mathbf{45}^{III}$ are arranged at a first short side edge of the lid 40 while the edge gripping lid coupling members $\mathbf{45}^{I}$ are arranged at the opposite short side edge of the lid 40. The upper frame member is provided with rim coupling members 55 allowing the lid 40 to be assembled with the container 1 even if turned 180° around the vertical axle.

Referring now to FIG. 7. The first and second side walls 31 and 32 respectively are provided with clamping hooks 62 arranged at a vertical edge $\mathbf{31}^{I}$ and $\mathbf{32}^{I}$ respectively. The third and fourth side walls 33 and 34 respectively are provided with clamping holes 63 at a position matching the position of the clamping hooks 62 when all side walls 31, 32, 33 and 34 respectively are erected. The interaction between the clamping hooks 62 and the clamping holes 63 will prevent unauthorised access to the content of the container caused by attempts at prizing adjacent side walls apart.

The invention is not limited by the embodiments shown since they can be altered in different ways within the scope of the invention.

What is claimed is:

1. Collapsible polymeric material container for transport and storage of goods, which container includes a carrying base part, a plurality of collapsible side walls and a lid, whereby said side walls are movably attached to said base part by means of lower hinge members, said side walls being arranged as a first and a second side wall being arranged parallel to each other and a third and a fourth side wall being arranged parallel to each other and adjacent to the first and the second side walls wherein said first and second side walls are moveably attached to an upper frame member via upper hinge members, said first and second side wall further being parted into each an upper and a lower section via a horizontal folding line, an upper edge of said third and fourth side walls being each provided with at least one locking lip, said locking lips limiting the outwards movement of said third and fourth side walls by interacting with an inner edge of said upper frame member, said third and fourth side walls being provided with at least one locking pin which each are inserted into one matching hole arranged on the inside of the upper rim, said hole and locking pin being arranged so that the locking pin and its matching hole will transfer loads exerted on the upper frame, wherein the lid is provided with an inner rim, said inner rim interacting with said inner edge of the upper frame member said inner rim further interacting with the locking lips thereby limiting inward movement of the third and fourth side walls while said lid is arranged on said collapsible container whereby undesired collapsing of said collapsible container is prevented while said lid is properly arranged on said container, the first and second side walls being each provided with clamping hooks arranged at a vertical edge, and the third and fourth side walls being each provided with clamping holes at positions matching the position of the clamping hooks when all side walls are erected, whereby said clamping hooks and said clamping holes are engageable so as to prevent unauthorized access to the contents of said container responsive to attempts of prying adjacent side walls apart.

2. Collapsible container according to claim 1 wherein the container is manufactured through means of a manufacturing method selected from a process consisting of injection moulding, vacuum moulding, blow moulding and press moulding.

3. Collapsible container according to claim 1 wherein the polymeric material of the container is selected from the group consisting of polyethylene, polypropylene, polybutene, polyvinylchloride, polyalkylene-therephtalate, acrylonitrile-butadiene-styrene-copolymer, polyamide, polycarbonate and combinations thereof.

4. Collapsible container according to claim 1 wherein said sealing pin is provided with snapping wedges and a manoeuvring section and that said locking pin is dimensioned to break at removal whereby unauthorised tampering with said collapsible container is made detectable.

5. Collapsible container according to claim 1 wherein said lid is provided with an upper rim, said upper rim being dimensioned to receive a footprint of said base part thereby securing vertical alignment of stacked collapsible containers with lids arranged thereon.

6. Collapsible container according to claim 1 wherein said upper frame member allows said lid to be arranged thereon when the collapsible container is in either an erected or a collapsed state.

7. Collapsible container according to claim 1 wherein the lid is provided with gripping lid coupling members in the form of edge gripping lid coupling members arranged at a short side edge, said edge gripping lid coupling members being interactable with edge hole rim coupling members arranged on the inside of the upper frame member.

8. Collapsible container according to claim 7 wherein the edge gripping lid coupling members and the edge hole rim coupling members are engageable with one another by horizontal sliding of the lid.

9. Collapsible container according to claim 7 wherein said lid is provided with gripping lid coupling members in at least two edges which coupling members are intended to interact with corresponding rim coupling members at the upper edge of the upper frame member.

10. Collapsible container according to claim 7 wherein said lid is provided with at least one coupling hole member which coupling hole member is intended to interact with corresponding rim coupling hole member at the upper edge of the upper frame member, said coupling hole member and rim coupling hole member being arranged so as to allowing a sealing pin to be inserted through said coupling hole member and rim coupling hole member.

11. Collapsible container according to claim 1 wherein the lid is provided with gripping lid coupling members in the form of top edge gripping lid coupling members arranged on at least one long side edge, said top edge gripping lid coupling members being intended to interact with top edge slot rim coupling member arranged on the top side of the upper frame member.

12. Collapsible container according to claim 11 wherein the top edge gripping lid coupling members and the top edge slot rim coupling members are intended to engage one another by downwards movement followed by horizontal sliding of the lid.

13. Collapsible container for transport and storage of goods, which container includes a carrying base part, a plurality of collapsible side walls and a lid, whereby said side walls are movably attached to said base part by means of lower hinge members, said side walls being arranged as a first and a second side wall being arranged parallel to each other and a third and a fourth side wall being arranged parallel to each other and adjacent to the first and the second side walls, wherein said first and second side walls are moveably attached to an upper frame member via upper hinge members, said first and second side wall further being parted into each an upper and a lower section via a vertical folding line, and wherein an upper edge of said third and fourth side walls are each provided with at least one locking lip, said locking lips limiting the outwards movement of said third and fourth side walls by interacting with an inner edge of said upper frame member, wherein the first and second side walls are provided with clamping hooks arranged at a vertical edge, that the third and fourth side walls are provided with clamping holes at a position matching the position of the clamping hooks when all side walls are erected, wherein said lid is provided with an inner rim, said inner rim interacting with said inner edge of said upper frame member said inner rim furthermore interacting with said locking lips thereby limiting inward movement of said third and fourth side walls and/or preventing undesired collapsing of said collapsible container while said lid is correctly arranged on said collapsible container, and wherein the lid is provided with gripping lid coupling members in the form of edge gripping lid coupling members arranged at a short side edge, said edge gripping lid coupling members being intended to interact with edge hole rim coupling members arranged on the inside of the upper frame member and top edge gripping lid coupling members arranged on at least one long side edge, said top edge gripping lid coupling members being intended to interact with top edge slot rim coupling member arranged on the top side of the upper frame member, said gripping lid coupling members being in the form of lid knob coupling members arranged at the short side edge, said lid knob coupling members being interactable with knob hole rim coupling members arranged on the upper end of the upper frame member, the lid knob coupling members and the knob hole rim coupling members being engageable with one another by downwards movement of the lid, whereby undesired and unauthorised access to the contents of said collapsible container is prevented while said lid is properly arranged and sealed on said erected container.

14. Collapsible container according to claim 13 wherein the lid knob coupling members are arranged at a first short side edge of the lid while the edge gripping lid coupling members are arranged at the opposite short side edge of the lid.

* * * * *